US010418772B2

(12) United States Patent
Kihara et al.

(10) Patent No.: US 10,418,772 B2
(45) Date of Patent: Sep. 17, 2019

(54) METHOD FOR MANUFACTURING TERMINAL-EQUIPPED ELECTRICAL WIRES

(71) Applicants: FURUKAWA ELECTRIC CO., LTD., Tokyo (JP); FURUKAWA AUTOMOTIVE SYSTEMS, INC., Inukami-gun (JP); TOYOTA JIDOSHA KABUSHIKI KAISHA, Toyota-shi (JP)

(72) Inventors: Yasushi Kihara, Tokyo (JP); Yukihiro Kawamura, Inukami-gun (JP); Takashi Tonoike, Inukami-gun (JP); Takahito Nakashima, Okazaki (JP); Hiroshi Kobayashi, Okazaki (JP); Hiroyasu Taga, Toyota (JP)

(73) Assignees: FURUKAWA ELECTRIC CO., LTD., Tokyo (JP); FURUKAWA AUTOMOTIVE SYSTEMS, INC., Inukami-gun (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 50 days.

(21) Appl. No.: 15/506,420

(22) PCT Filed: Aug. 25, 2015

(86) PCT No.: PCT/JP2015/073783
§ 371 (c)(1),
(2) Date: Feb. 24, 2017

(87) PCT Pub. No.: WO2016/031795
PCT Pub. Date: Mar. 3, 2016

(65) Prior Publication Data

US 2018/0248327 A1 Aug. 30, 2018

(30) Foreign Application Priority Data

Aug. 25, 2014 (JP) ..... 2014-170469

(51) Int. Cl.
*H01R 4/02* (2006.01)
*H01R 4/10* (2006.01)
(Continued)

(52) U.S. Cl.
CPC ..... *H01R 43/048* (2013.01); *H01R 4/18* (2013.01); *H01R 43/005* (2013.01); *H01R 4/183* (2013.01)

(58) Field of Classification Search
CPC ..... H01R 4/206; H01R 4/62; H01R 13/52
(Continued)

(56) References Cited

U.S. PATENT DOCUMENTS 3,955,044 A * 5/1976 Hoffman ..... H01R 4/203 174/84 C
5,408,743 A 4/1995 Tournier et al.
(Continued)

FOREIGN PATENT DOCUMENTS

CN 102037622 A 4/2011
CN 102859795 A 1/2013
(Continued)

OTHER PUBLICATIONS

Combined Office Action and Search Report dated Feb. 4, 2017 in Chinese Patent Application No. 201480009829.6 with English translation.
(Continued)

*Primary Examiner* — Abdullah A Riyami
*Assistant Examiner* — Thang H Nguyen
(74) *Attorney, Agent, or Firm* — Oblon, McClelland, Maier & Neustadt, L.L.P.

(57) ABSTRACT

When molds (31*a*), (31*b*) are caused to mesh so that a crimping portion (5) is compressed, the crimping portion (5)

is crimped to conductive wires (25) and a cover portion (27). A conductor crimping portion (7) is completely compressed by the molds (31*a*), (31*b*). A cover crimping portion (9) preliminarily compresses the cover portion (27). Next, temporarily compressed terminal-equipped electrical wires are disposed between different molds. When the molds are caused to mesh so that the crimping portion (5) is compressed, the cover crimping portion (9) is forcefully compressed. In other words, the cover crimping portion (9) is subjected to final compression. In other words, the present invention is provided with a first compression step for preliminarily compressing the cover portion (27) and a second compression step for forcefully compressing the covering part.

4 Claims, 10 Drawing Sheets

(51) Int. Cl.

| | |
|---|---|
| ***H01R 43/02*** | (2006.01) |
| ***H01R 43/048*** | (2006.01) |
| ***H01R 4/18*** | (2006.01) |
| ***H01R 43/00*** | (2006.01) |

(58) Field of Classification Search
USPC ..... 29/860; 439/877–876
See application file for complete search history.

(56) References Cited

U.S. PATENT DOCUMENTS

| | | | | |
|---|---|---|---|---|
| 8,690,614 | B2 * | 4/2014 | Eshima | H01R 4/185 439/882 |
| 9,065,189 | B2 * | 6/2015 | Ohnuma | H01R 4/185 |
| 9,680,235 | B2 * | 6/2017 | Kawamura | H01R 4/20 |
| 10,033,146 | B2 * | 7/2018 | Tachibana | H01R 4/62 |
| 2004/0168315 | A1 | 9/2004 | Onuma | |
| 2009/0191771 | A1 | 7/2009 | Watanabe | |
| 2010/0144189 | A1 | 6/2010 | Watanabe et al. | |
| 2013/0095708 | A1 | 4/2013 | Mitose et al. | |
| 2015/0027777 | A1 * | 1/2015 | Drew | H01R 4/185 174/72 A |
| 2015/0079857 | A1 * | 3/2015 | Kawamura | H01R 43/0482 439/877 |
| 2015/0126079 | A1 * | 5/2015 | Kawamura | H01R 4/206 439/877 |
| 2015/0332809 | A1 * | 11/2015 | Natoli | H01R 4/029 174/74 R |
| 2015/0340772 | A1 * | 11/2015 | Kawamura | H01R 4/187 439/877 |
| 2015/0364833 | A1 * | 12/2015 | Tonoike | H01R 4/183 439/879 |
| 2015/0364835 | A1 * | 12/2015 | Tonoike | H01R 43/0488 439/879 |
| 2016/0218443 | A1 * | 7/2016 | Tonoike | H01R 4/62 |
| 2017/0331202 | A1 * | 11/2017 | Aoki | H01R 4/185 |

FOREIGN PATENT DOCUMENTS

| | | | | |
|---|---|---|---|---|
| CN | 103229359 | A | 7/2013 | |
| GB | 1298071 | | 11/1972 | |
| JP | 49-13311 | | 3/1974 | |
| JP | 53-16640 | Y1 | 5/1978 | |
| JP | 58-118623 | U | 8/1983 | |
| JP | 61-188278 | U | 11/1986 | |
| JP | 3-37760 | U | 4/1991 | |
| JP | 9-7649 | A | 1/1997 | |
| JP | 2002-124310 | A | 4/2002 | |
| JP | 2002-198155 | A | 7/2002 | |
| JP | 2004-71437 | A | 3/2004 | |
| JP | 2006-331931 | A | 12/2006 | |
| JP | 2009-176571 | A | 8/2009 | |
| JP | 2009-301839 | A | 12/2009 | |
| JP | 2010-140651 | A | 6/2010 | |
| JP | 4598039 | B2 | 12/2010 | |
| JP | 4616700 | B2 * | 1/2011 | H01R 4/203 |
| JP | 2012-79654 | A | 4/2012 | |
| JP | 5583303 | B1 | 9/2014 | |
| JP | 5603521 | B1 | 10/2014 | |
| JP | 5607851 | B2 | 10/2014 | |
| WO | 2014/014103 | A1 | 1/2014 | |

OTHER PUBLICATIONS

Decision to Grant a Patent dated Apr. 10, 2017 in Japanese Patent Application No. 2014-170469 (with English translation).
International Search Report dated Nov. 17, 2015, in PCT/JP2015/073783, filed Aug. 25, 2015.
International Search Report dated May 27, 2014, in PCT/JP2014/054239.
Japanese Office Action dated May 15, 2014, in Japanese Patent Application No. 2014-511671 (with English translation).
Japanese Office Action dated Apr. 21, 2014, in Japanese Patent Application No. 2014-508204 (with English translation).
Japanese Office Action dated Sep. 30, 2016, in Japanese Patent Application No. 2014-170469 (with English translation).
Decision to Grant dated Jul. 14, 2014, in Japanese Patent Application No. 2014-508204 (with English translation).
Decision to Grant dated Aug. 11, 2014, in Japanese Patent Application No. 2014-140624 (with English translation).
Decision to Grant dated Jun. 12, 2014, in Japanese Patent Application No. 2014-511671 (with English translation).
International Search Report dated Apr. 1, 2014, in PCT/JP2014/050305.
Combined Office Action and Search Report dated May 3, 2018 in Chinese Patent Application No. 201580028228.4 (with English language translation), 15 pages.

* cited by examiner

METHOD FOR MANUFACTURING TERMINAL-EQUIPPED ELECTRICAL WIRES

TECHNICAL FIELD OF THE INVENTION

This invention relates to a method for manufacturing terminal-equipped electrical wires that are used for motor vehicles and the like.

BACKGROUND OF THE INVENTION

For connecting an electrical wire and a terminal in a wire harness for motor vehicles, crimp joining, in which an electrical wire is caulked and crimped by a terminal called open-barrel type, has been commonly known. However, in such a wire harness, if moisture or the like adheres to the connecting part of the electrical wire and the terminal, oxidization of the surface of the metal used for the electrical wire progresses, increasing the resistance at the joint part. Also, if different metals are used for the electrical wire and the terminal, corrosion between different metals may progress. The progress of corrosion of metal materials at the connecting part causes cracks or contact failure at the connecting part, and its effect on product life is unavoidable. Particularly in recent years, a wire harness having electrical wires made of aluminum alloy and terminals made of copper alloy has been in practical use, and the problem of corrosion at the joint part has become noteworthy.

Here, if moisture adheres to the contacting part of different metals such as aluminum and copper for example, so-called electrolytic corrosion may occur due to difference in corrosion potential. Since the potential difference between aluminum and copper is especially large, corrosion on the side of aluminum, which is an electrically base metal, progresses. Thus, the connection state between conductive wires and crimp terminals becomes unstable, causing an increase in contact resistance or in electrical resistance due to decrease in wire diameters, and, furthermore, disconnection of the wires, which may result in malfunction or breakdown of the electrical components.

For such a wire harness having different metals contacting with each other, for example, a method using a terminal having a cylindrical crimping portion of which one end is closed has been proposed (Patent Document 1): the method includes inserting an end part of electrical wires into the cylindrical crimping portion, and then crimping the cylindrical crimping portion by caulking so as to prevent the end part of the core wires from adhesion of moisture such as rain water or sea water.

RELATED ART

Patent Documents

[Patent Document 1] Japanese Unexamined Patent Application Publication No. 2006-331931 (JP-A-2006-331931)

SUMMARY OF THE INVENTION

Problems to be Solved by the Invention

However, with a crimping portion of which an end part is sealed as in Patent Document 1, water may enter from the crimping portion if a cover portion and the crimping portion are not fully adhered to each other.

The present invention was achieved in view of such problems. Its object is to provide a method for manufacturing terminal-equipped electrical wires that can have high water cut-off performance.

Means for Solving Problems

To achieve the above object, the present invention provides a method for manufacturing a terminal-equipped electrical wire that includes a covered conductive wire connected with a terminal. The terminal includes a crimping portion, which crimps the covered conductive wire, and a terminal body. The crimping portion includes a cover crimping portion, which crimps a cover portion of the covered conductive wire, and a conductor crimping portion, which crimps a conductive wire exposed from the cover portion and parts of the crimping portion other than a part into which the covered conductive wire is inserted are sealed. The method includes inserting the covered conductive wire into the crimping portion, a first step of crimping the conductor crimping portion and the conductive wire as well as temporarily crimping the cover crimping portion and the cover portion, and a second step, following the first step, of firmly crimping the cover crimping portion and the cover portion.

The second step of crimping may include forming a protruded linear-portion that protrudes toward an inner surface of the cover crimping portion and is continuous in a circumferential direction.

It is preferable that two or more rows of the protruded linear-portions are formed.

It is preferable that a compression rate at the cover portion of the covered conductive wire in the first step of crimping is 85% or more and less than 100%.

The first step of crimping may include a step of temporarily crimping the cover portion by the cover crimping portion followed by a stop of crimping the conductor crimping portion and the conductive wire by the conductor crimping portion.

According to the present invention, the cover crimping portion is crimped in two steps so that the cover portion is crimped completely after the conductive wire is completely crimped. This enables to prevent weak crimping at the cover portion due to deformation of the conductor or stretching of the electrical wire at the time of crimping the conductive wire. Thus, it is possible to prevent moisture entry from a gap between the crimping terminal and the cover portion so as to prevent moisture adherence to the contacting part of the electrical wire and the terminal. Here, "crimping the conductor crimping portion and the conductive wire as well as temporarily crimping the cover crimping portion and the cover portion" includes both a case in which the cover crimping portion and the cover portion are temporarily crimped at the same time as crimping the conductor crimping portion and the conductive wire and a case in which there is a time difference between crimping the conductor crimping portion and the conductive wire and temporarily crimping the cover crimping portion and the cover portion. Furthermore, needless to say, "crimping the cover crimping portion and the cover portion" means that not only the cover crimping portion and the cover portion are crimped together but also the conductive wire within the cover portion is compressed at the same time.

In addition, high water cut-off performance can be obtained with certainty by forming the protruded linear-portion on the inner surface of the cover crimping portion. Moreover, forming two or more rows of the protruded linear-portions can further improve the water tightness.

In addition, by making the compression rate of the cover portion in the first step of crimping 85% or more, the final sufficient amount of compression can be obtained for the second step of crimping.

In addition, in the first step of crimping, the cover portion may be temporarily crimped first, instead of crimping the cover portion temporarily and crimping the conductive wire at the same time. Temporarily crimping in advance can prevent unexpected shifting of the cover portion at the time of crimping the conductive wire.

Effects of the Invention

The present invention can provide a method for manufacturing terminal-equipped electrical wires that can have high water cut-off performance.

DESCRIPTION OF SOME EMBODIMENTS

First Embodiment

Figure 1:
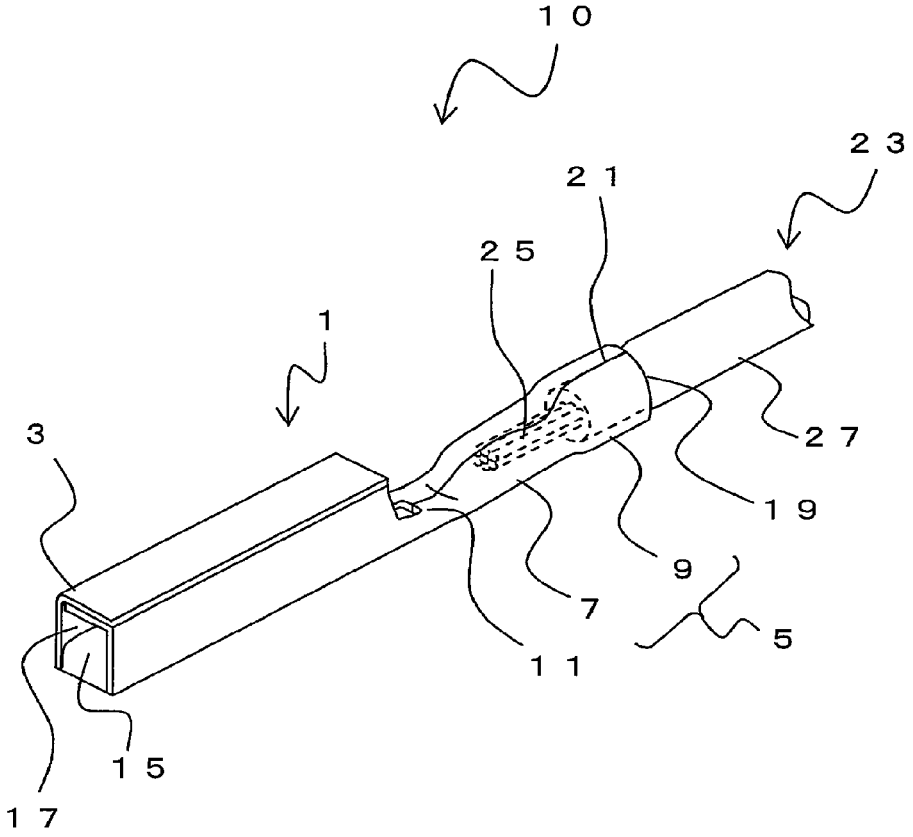
FIG. 1 is a perspective view of a terminal-equipped electrical wire 10.
Figure 2:
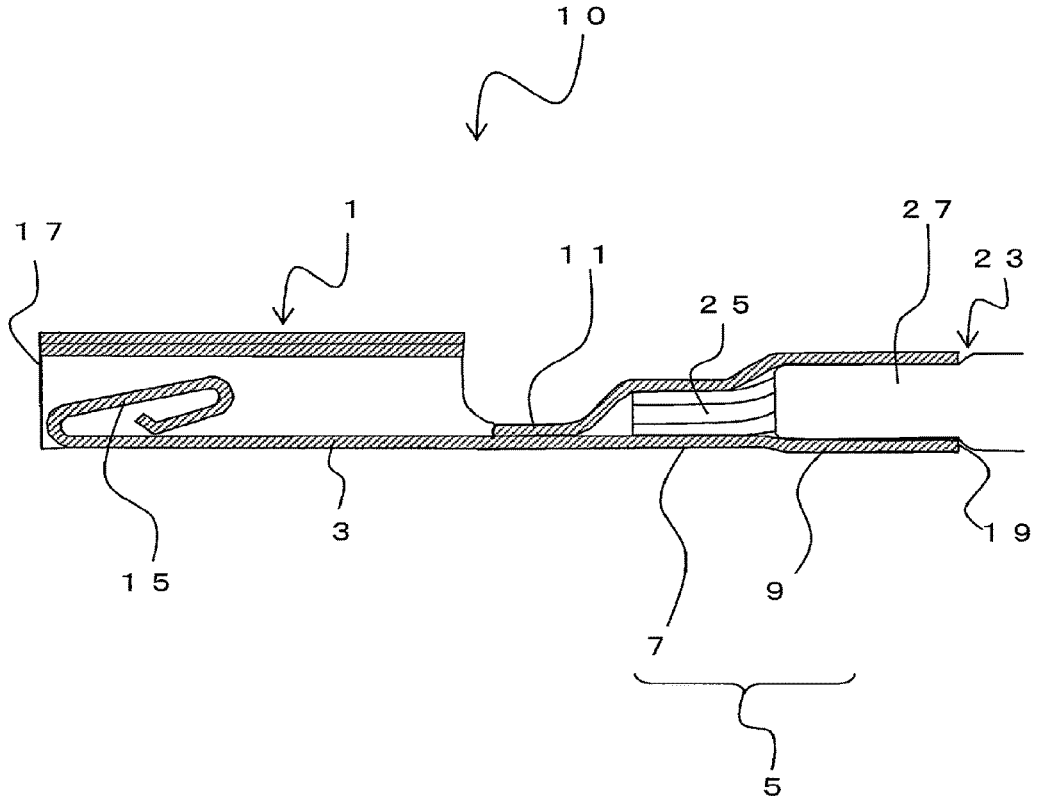
FIG. 2 is a cross-sectional view of the terminal-equipped electrical wire 10.

FIG. 1 is a perspective view showing a terminal-equipped electrical wire 10 according to an embodiment of the present invention and FIG. 2 is a cross-sectional view in an axial direction of the terminal-equipped electrical wire 10. The terminal-equipped electrical wire 10 includes a terminal 1 and a covered conductive wire 23 that are crimped together.

The covered conductive wire 23 includes a conductive wire 25 that is covered by an insulating cover portion 27. The conductive wire 25 is made of, for example, aluminum based material. When inserting the covered conductive wire 23 into a crimping portion 5 of the terminal 1, a part of the cover portion 27 at the tip of the covered conductive wire 23 is removed to expose the conductive wire 25. For the cover portion 27, any of commonly used materials in this technical field, such as polyvinyl chloride (PVC) or polyethylene, can be chosen.

The terminal 1 is made of copper and includes a terminal body 3 and the crimping portion 5 to which the covered conductive wire 23 is crimped. The terminal body 3 is made of a plate-like member of a predetermined shape that is formed into a tubular body having a rectangular cross section. The terminal body 3 has an elastic contacting piece 15, which is formed by folding the plate-like member into the rectangular tubular body, at a front-end portion 17. The terminal body 3 is connected to a male terminal or the like that is to be inserted from the front-end portion 17.

The crimping portion 5 is formed as a rolled up cylinder having a circular cross section, and its side edges are butted to each other and joined at a joint portion 21 to be integrated. The covered conductive wire 23 is inserted into the cylindrically formed crimping portion 5 from a rear-end portion 19. In addition, a sealed portion 11 is provided at the front end of the crimping portion 5 (on the side of the terminal body 3). That is, the crimping portion 5 is in a substantially cylindrical shape with a sealed end: parts of the crimping portion 5 except for the rear-end portion 19 into which the covered conductive wire is to be inserted are sealed. The joint portion 21 and the scaled portion 11 are welded by, for example, laser welding or the like.

The crimping portion 5 includes a cover crimping portion 9, which crimps the cover portion 27 of the covered conductive wire 23, and a conductor crimping portion 7, which crimps the conductive wire 25 that is exposed by removing a tip part of the cover portion of the covered conductive wire 23.

Figure 3A:
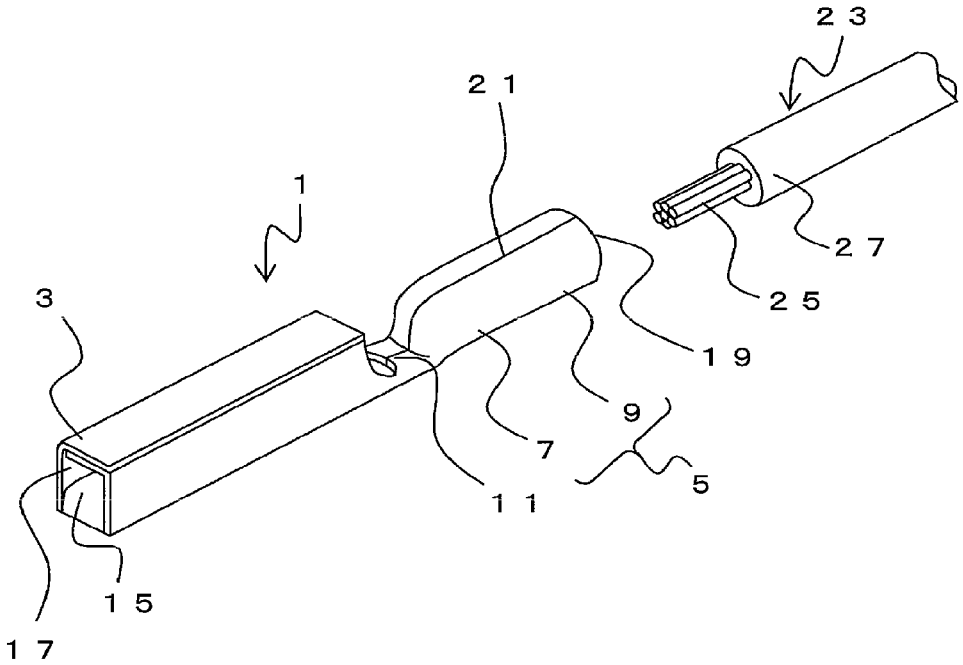
FIG. 3*a* is an exploded perspective view of a terminal-equipped electrical wire.
Figure 3B:
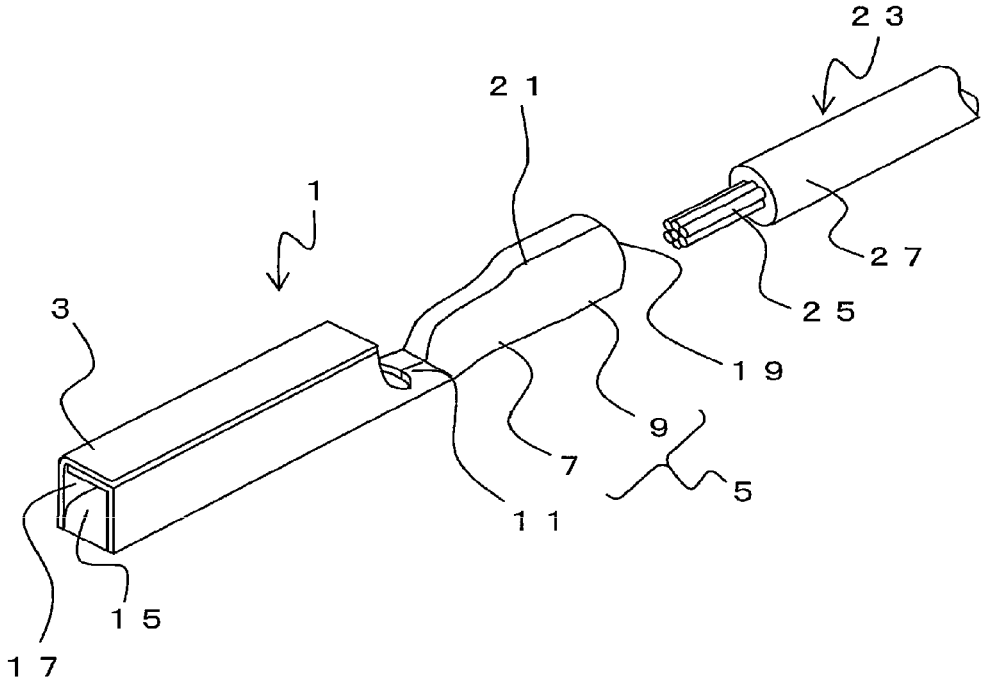
FIG. 3*b* is an exploded perspective view of a terminal-equipped electrical wire.

Next, a method for manufacturing a terminal-equipped electrical wire will be described. FIG. 3*a* and FIG. 3*b* are both exploded perspective views showing a state before the covered conduction wire 23 is inserted into the terminal 1. For the terminal 1 before crimping, a terminal shown in FIG. 3*a* that has the conductor crimping portion 7 and the cover crimping portion 9 formed with the same diameter can also be used.

Alternatively, as shown in FIG. 3*b*, the terminal 1 having the conductor crimping portion 7 and the cover crimping portion 9 formed with different outer and inner diameters in advance can also be used. In this case, the conductor crimping portion 7 has the outer and inner diameters that are smaller than those of the cover crimping portion 9, respectively. By changing the diameters of the conductor crimping portion 7 and the cover crimping portion 9 in advance as above so to make the inner diameter of the cover crimping portion 9, which crimps the cover portion 27 of a larger diameter, larger than the inner diameter of the conductor crimping portion 7, which crimps the conductive wire 25 of a smaller diameter, the amount of compression of the terminal 1 can be reduced.

Hereinafter, an example of the terminal 1 shown in FIG. 3*b*, which includes the conductor crimping portion 7 and the cover crimping portion 9 formed with different outer and inner diameters in advance, will be described.

First, as shown in FIG. 3*b*, a predetermined length of the cover portion 27 at the tip of the covered conductive wire 23 is removed to expose the conductive wire 25. Next, the covered conductive wire 23 is inserted into the cylindrical crimping portion 5. At this time, the exposed part of the conductive wire 25 is positioned inside the conductor crimping portion 7, and the cover portion 27 is positioned inside the cover crimping portion 9.

As mentioned above, the crimping portion 5 is rolled up into a substantially cylindrical shape and the edge parts are joined at the joint portion 21. In addition, the scaled portion 11 is provided at the front-end portion of the crimping portion 5 (on the side of the terminal body 3). That is, the crimping portion 5 is sealed except for the rear-end portion 19 into which the covered conductive wire 23 is inserted.

Figure 4A:
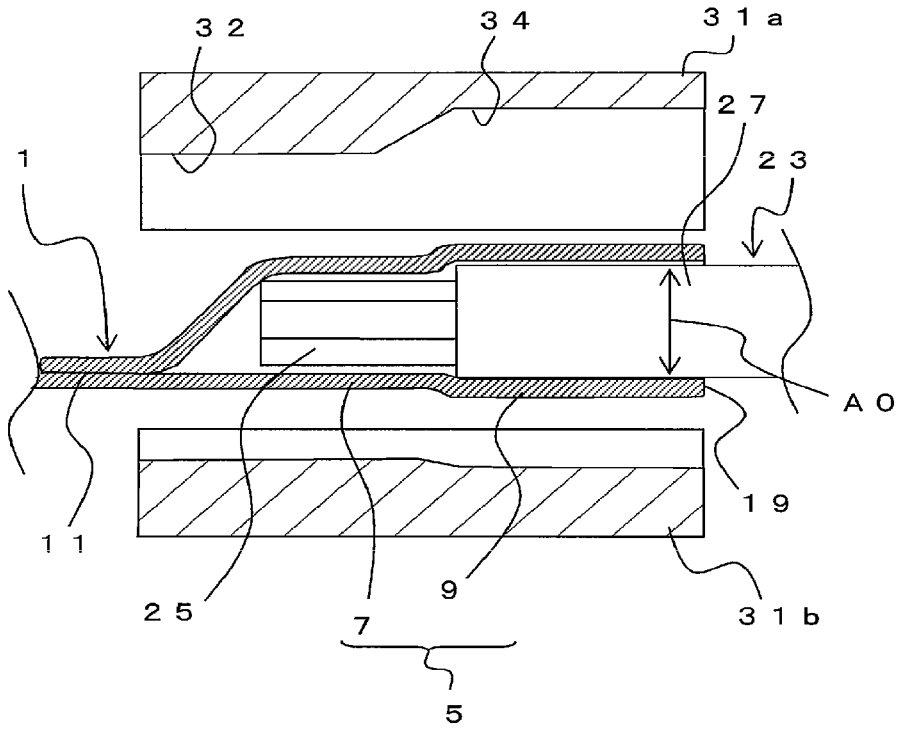
FIG. 4*a* is a cross-sectional view showing a crimping portion 5 disposed between a mold 31*a* and a mold 31*b* before crimping.
Figure 4B:
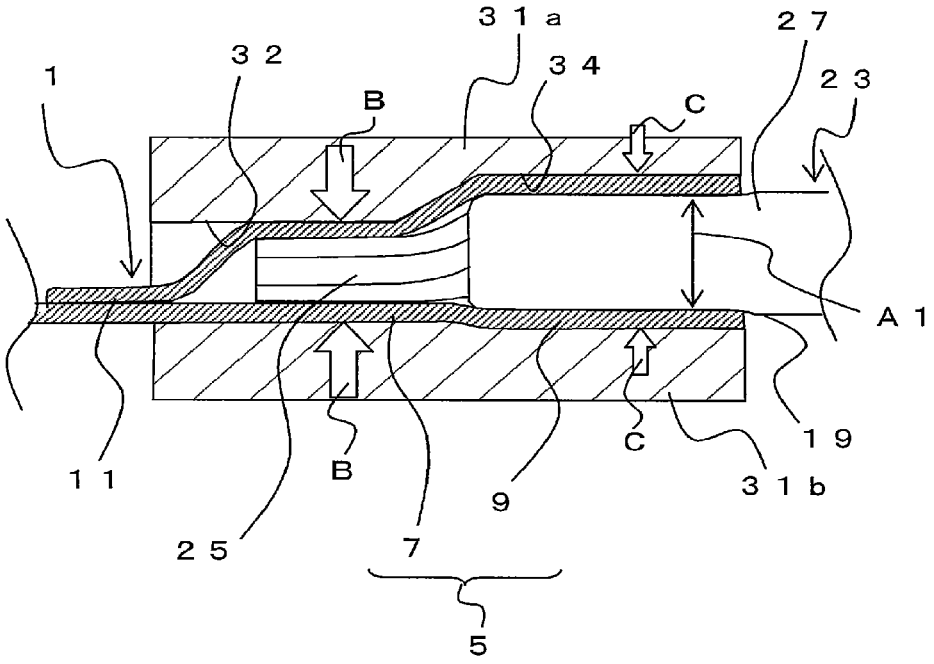
FIG. 4*b* is a cross-sectional view showing the crimping portion 5 disposed between the mold 31*a* and the mold 31*b* after crimping.

FIG. 4*a* is a cross-sectional view showing the molds 31*a* and 31*b* and the like before crimping, and FIG. 4*b* is a cross-sectional view showing the crimping portion 5 during crimping. The mold 31*a* has a semi-cylindrical cavity extending in the longitudinal direction, and includes a large-diameter portion 34, which corresponds to the cover crimping portion 9 and has a radius slightly smaller than the radius of the cover crimping portion 9, and a small-diameter portion 32, which corresponds to the conductor crimping portion 7 and has a radius smaller than the larger-diameter portion 34. The mold 31*b* has a semi-cylindrical cavity extending in the longitudinal direction, and the radii of the parts corresponding to the conductor crimping portion 7 and the cover crimping portion 9 differ in a similar way as in the mold 31*a*. The large-diameter portion 34 is a part that crimps the cover crimping portion 9, and the small-diameter portion 32 is a part that crimps the conductor crimping portion 7.

As shown in FIG. 4*b*, the molds 31*a* and 31*b* are meshed together to compress the crimping portion 5 so that the crimping portion 5 is crimped to the conductive wire 25 and the cover portion 27. Here, the conductor crimping portion 7 is crimped completely by the molds 31*a* and 31*b* (B in the drawing). Meanwhile, the cover crimping portion 9 temporarily crimps the cover portion 27 (C in the drawing).

Here, the compression rate=A1/A0 is preferably 85% or more and less than 100%, wherein A0 is a cross-sectional area of the covered conductive wire 23 at the cover portion 27 before crimping and A1 is an inner cross-sectional area of the cover crimping portion 9 after being crimped by the molds 31*a* and 31*b*. If the compression rate is 100%, it means that the cover portion 27 is not crimped at all and the effect of the present invention will be small. On the other hand, with the compression rate less than 85%, the effect of the present invention cannot be obtained.

As described above, in the present invention, the molds 31*a* and 31*b* first crimp the conductive wire 25 and temporarily crimp the cover portion 27. Hereinafter, this process of crimping the conductive wire 25 and temporarily crimping the cover portion 27 will be called as a first step of crimping.

Figure 5A:
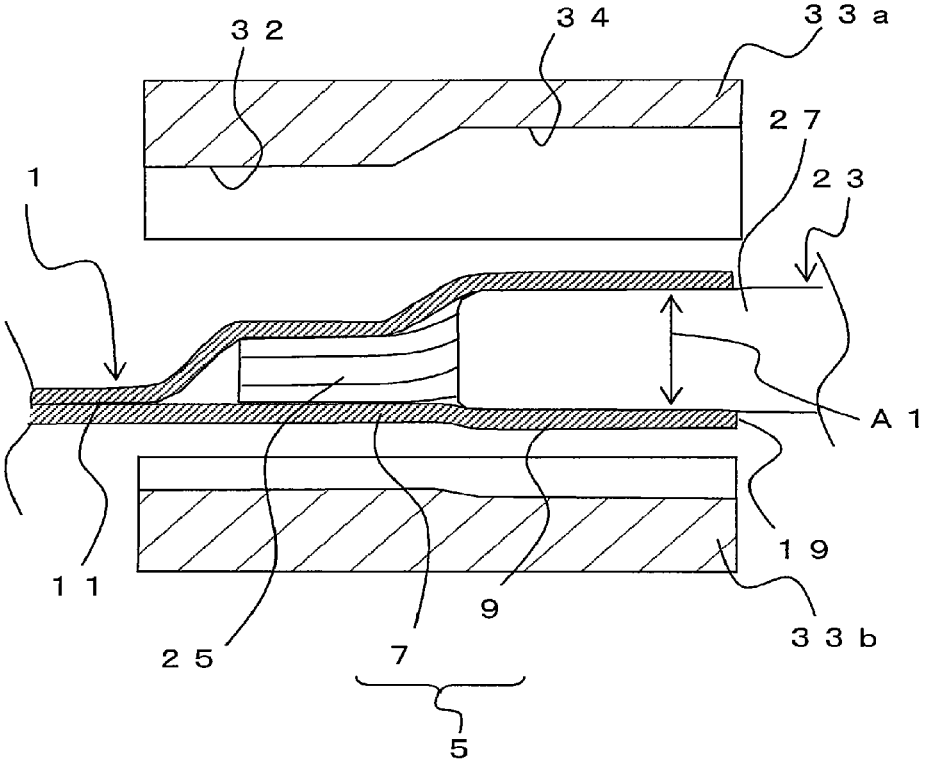
FIG. 5*a* is a cross-sectional view showing the crimping portion 5 disposed between a mold 33*a* and a mold 33*b* before crimping.

Next, as shown in FIG. 5*a*, the temporarily crimped terminal-equipped electrical wire is disposed between the molds 33*a* and 33*b*. Although the molds 33*a* and 33*b* have almost the same structure as the molds 31*a* and 31*b*, the diameters of the large-diameter portions 34 differ. The inner diameters of the large-diameter portions 34 of the molds 33*a* and 33*b* are smaller than the inner diameters of the large-diameter portions 34 of the molds 33*a* and 33*b*, respectively. The inner diameters of the small-diameter portions 32 of the molds 33*a* and 33*b* are substantially equal to the inner diameters of the small-diameter portions 32 of the molds 33*a* and 33*b*.

Figure 5B:
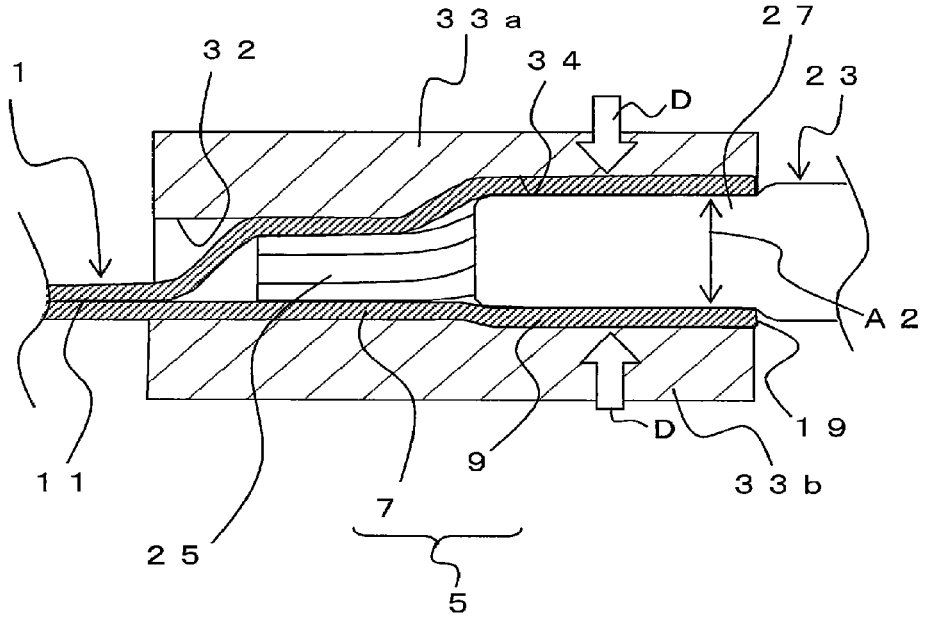
FIG. 5*b* is a cross-sectional view showing the crimping portion 5 disposed between the mold 33*a* and the mold 33*b* after crimping.

Next, as shown in FIG. 5*b*, the molds 33*a* and 33*b* are meshed together to compress the crimping portion 5, and then the cover portion 27 and the cover crimping portion 9 are crimped firmly (D in the drawing). That is, the cover crimping portion 9 is crimped permanently. A2/A0 is the final compression rate wherein A2 is an inner cross-sectional area of the cover crimping portion 9 after being crimped. The final compression rate is preferably 50% or more to prevent breaking of the cover and is preferably less than 85% to obtain a high adherence property at the crimped part.

When the molds 33*a* and 33*b* crimp the crimping portion 5, the conductor crimping portion 7 is not crimped anymore. Thus, the small-diameter portions 32 of the molds 33*a* and 33*h* have a function to prevent the deformation of the conductor crimping portion 7 only. Alternatively, the molds 33*a* and 33*b* may have only the large-diameter portions 34 for crimping, without forming the small-diameter portions 32. Hereinafter, this final step of crimping of the cover crimping portion 9 will be called as a second step of crimping.

In this way, after being crimped by the molds 33*a* and 33*b*, the inner surface of the cover crimping portion 9 and the outer surface of the cover portion 27 are adhered together, enabling to seal the crimping portion 5. At this time, all the parts of the crimping portion 5 other than the rear-end portion 19 are sealed by the joint portion 21 and the sealed portion 11 for water-tightness, and thus moisture entry into the crimping portion 5 can be prevented. As above, the terminal-equipped electrical wire 10 is manufactured.

As described above in the present embodiment, by crimping the cover portion 27 in two steps, the terminal-equipped electrical wire 10 with high water cut-off performance can be manufactured. If, for example, the conductor crimping portion 7 and the cover crimping portion 9 are permanently crimped at the same time by using only the molds 31*a* and 31*b* instead of crimping the cover crimping portion 9 in two steps, the crimping of the conductor crimping portion 7 may cause a part of the conductive wire 25 to be pulled in a direction toward the conductor crimping portion 7. This may likely generate some parts of the cover portion 27 that are strongly pressed to a part of the cover portion 27 by the conductive wire 25 and some parts with weak compression. Thus, at the strongly pressed parts, the cover portion 27 is crushed too much and sufficient repulsive force cannot be obtained, and, at the parts of the cover portion 27 where the compression is weak, adhesion is weak, reducing the water cut-off performance.

In addition, when the conductor crimping portion 7 is crimped, the conductor of the terminal 1 extends toward the cover crimping portion 9 side. For this reason, the cover portion 27 inside is firmly crimped following the extension of the cover crimping portion 9. As a result, the cover portion 27 is not only compressed by the cover crimping portion 9 in a direction toward the center of the cross section, but also is compressed being shifted toward the axial direction. This may cause the compression force given to the cover portion 27 in a direction perpendicular to the axial direction of the tube to be released in the axial direction, and sufficient compression force may not be obtained.

In contrast, in the present invention, the cover crimping portion 9 is only temporarily crimped while the conductor crimping portion 7 is crimped. This permits the cover portion 27 some movement against the cover crimping portion 9. For this reason, shifting or the like of the cover portion 27 toward the axial direction can be absorbed when crimping the conductor crimping portion 7. Thus, the cover portion 27 can be firmly crimped while the cover portion 27 is in a stable state. For this reason, it is unlikely that the compression force on the cover portion 27 is released toward the axial direction or that a difference of compression amount on different parts may be generated.

If the compression rate for the temporary crimping is less than 85%, the above-mentioned movement of the cover portion 27 is not sufficiently permitted and, in addition, it is unable to obtain the required compression rate for the permanent crimping. Thus, the compression rate for the temporary crimping is preferably 85% or more.

Second Embodiment

Figure 6A:
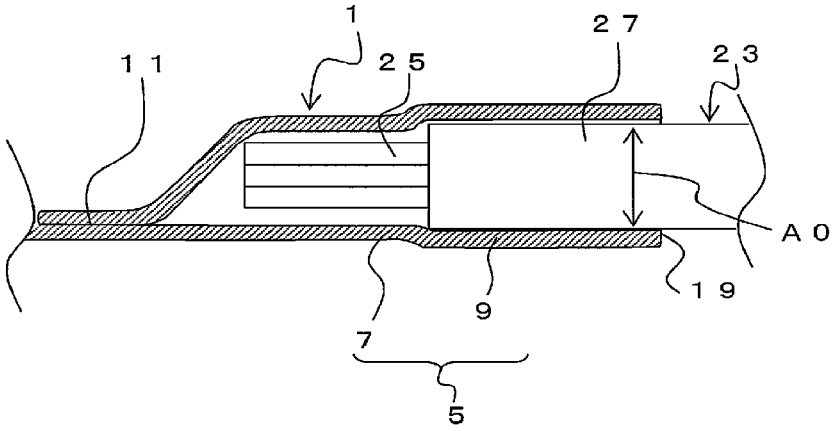
FIG. 6*a* shows a view before crimping.
Figure 6B:
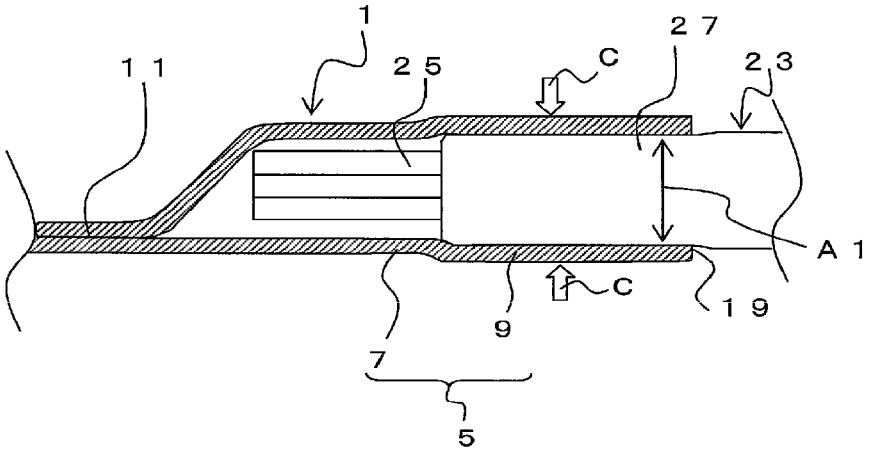
FIG. 6*b* is a view showing a temporarily crimped cover crimping portion 9.
Figure 6C:
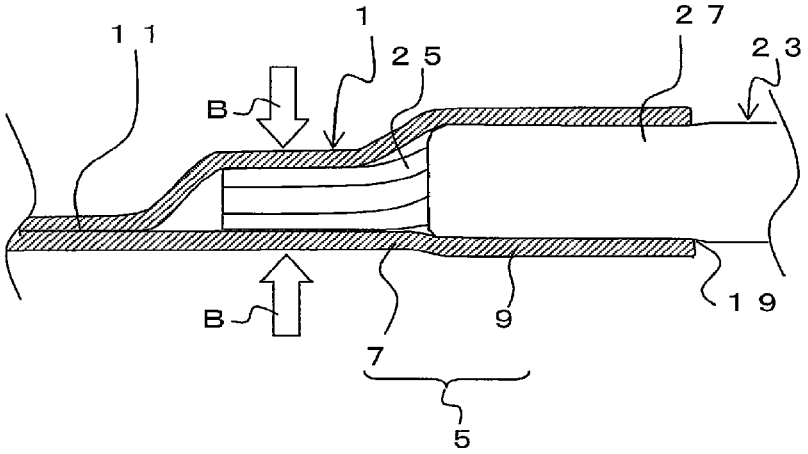
FIG. 6*c* is a view showing a crimped conductor crimping portion 7.

Next, a second embodiment will be described. FIG. 6*a*, FIG. 6*b*, and FIG. 6*c* are drawings to show the first step of crimping according to the second embodiment. Hereinafter, the same notations as in FIG. 1 to FIG. 5*a* and FIG. 5*b* will be used for the same structures as in the first embodiment and redundant descriptions will be omitted. Also, in FIG. 6*a* to FIG. 6*c*, the molds will be omitted in the drawings.

The second embodiment is configured almost as the same as the first embodiment except that the first step of crimping is further performed in two steps. First, as shown in FIG. 6*a*, the tip of the covered conductive wire 23 is inserted into the crimping portion 5 of the terminal 1. The area of cross section of the cover portion 27 at this time is A0.

Then, as shown in FIG. 6*b*, only the cover crimping portion 9 is temporarily crimped (C in the drawing). When the area of the inner cross section of the cover crimping portion 9 after crimping is A1, A1/A0 is 85% or more and less than 100%, as in the first embodiment. At this time, the conductor crimping portion 7 is not yet crimped.

Next, as shown in FIG. 6*c*, only the conductor crimping portion 7 is permanently crimped (C in the drawing). At this time, the cover crimping portion 9 is not crimped. As described above, only the cover crimping portion 9 can be crimped temporarily at first and then the conductor crimping portion 7 alone can be crimped later. That is, the first step of crimping may be divided into two steps. The second step of crimping should follow this first step similarly as in the first embodiment.

According to the second embodiment, the same effects as in the first embodiment can be obtained. That is, when the conductor crimping portion 7 is crimped, the covered crimping portion 9 is temporarily crimped and thus the movement or the like of the cover portion 27 toward the axial direction is permitted. In addition, since the cover portion 27 is not completely free to move, excessive movement of the cover portion 27 in backward direction, for example, can be prevented. In addition, since the crimping is done in turn of temporary crimping the cover crimping portion 9 at first, crimping the conductor crimping portion 7 next, and then permanently crimping the cover crimping portion 9 at last, the cover portion 27 and the conductive wire 25 are crimped while balancing the compression rates thereon, and thus the compression rates do not vary widely and crimping can be done with more certainty.

Third Embodiment

Figure 7A:
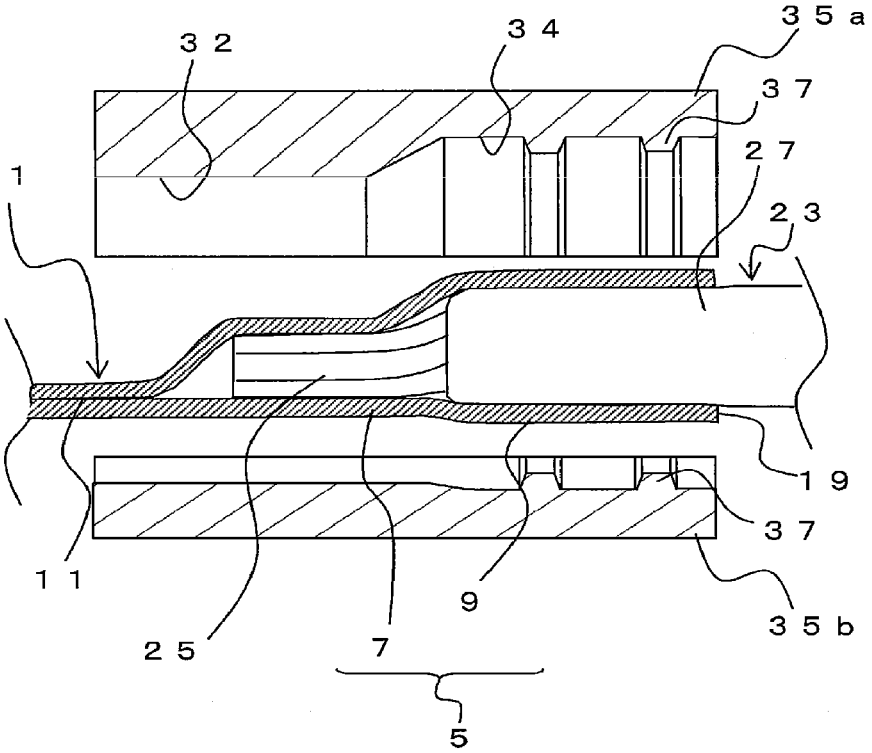
FIG. 7*a* is a cross-sectional view showing the crimping portion 5 disposed between a mold 35*a* and a mold 35*b* after crimping.
Figure 7B:
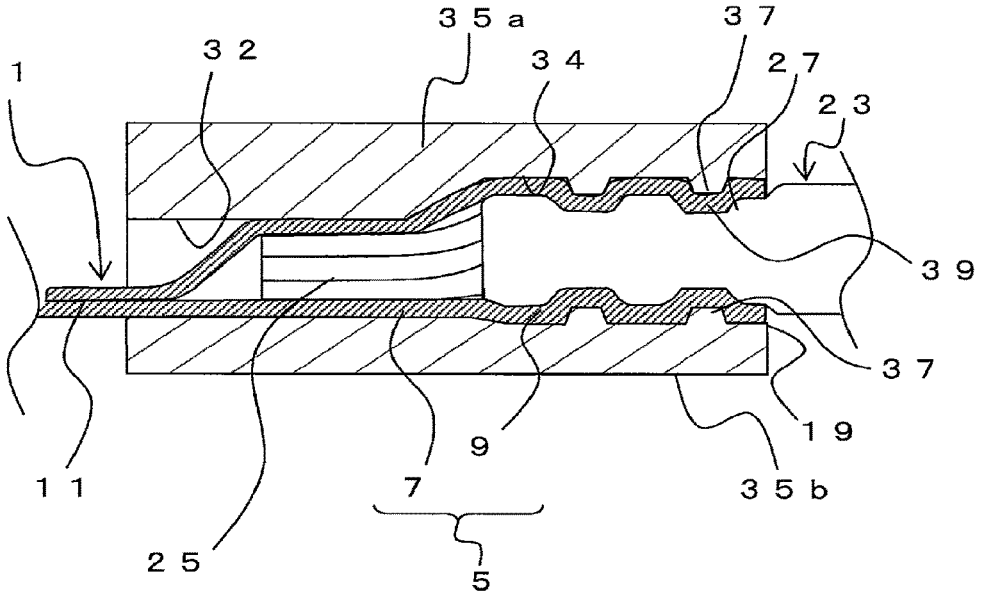
FIG. 7*b* is a cross-sectional view showing the crimping portion 5 disposed between the mold 35*a* and the mold 35*b* after crimping.

Next, a third embodiment will be described. FIG. 7*a* and FIG. 7*b* are drawings to show the second step of crimping according to the third embodiment. The third embodiment is configured almost as the same as the first embodiment except that protruded linear-portions 39 are formed on the cover crimping portion 9 in the second step of crimping.

First, the first step of crimping is performed in the same way as the first or second embodiment. Next, the terminal-equipped electrical wire that has gone through the first step of crimping is disposed between the molds 35*a* and 35*b*.

Each of the molds 35*a* and 35*b* has protruding portions 37 formed, which protrude inward. The protruding portions 37 are continuous in circumference direction on inner circumferential surfaces of the molds 35*a* and 35*h*. That is, when the molds 35*a* and 35*b* are put together, the protruded portions 37 are continuous in ring shapes in the inner circumferential direction of the molds 35*a* and 35*b*. The parts of outer circumferential surfaces of the cover crimping portion 9 corresponding to the protruding portions 37 of the molds 35*a* and 35*b* are pushed in strongly. Thus, on the inner circumferential surface of the cover crimping portion 9, the protruded linear-portions 39 that protrude toward the inner side of the diameter direction are formed at the parts corresponding to the protruded portions 37 of the molds 35*a* and 35*b*.

The parts with the protruded linear-portions 39 have smaller diameters than the other parts. The number of arrangement of the protruded linear-portions 39 is not necessarily two as shown in the drawing, but should be at least one. However, to improve water cut-off property, it is preferable that two or more rows of protruded linear-portions 39 are formed.

By providing the ring shaped protruded linear-portions 39 on the cover crimping portion 9 in its circumferential direction as above, some parts of the cover portion 27 are crimped by the protruded linear-portions 39 with stronger force than the other parts, forming highly crimped parts. As a result, a further enhanced water cut-off performance can be obtained. At this time, it is preferable that both of the compression rate at the highly crimped part and the compression rate at the other parts are 50% or more and less than 85%. In addition, the depth of grooves that appear on the outer surface side of the cover crimping portion 9 corresponding to the protruded linear-portions 39 is preferably 75% or less of the thickness of the cover portion of the crimping object before crimping. This is because the cover may break if the pushed-in depth of the cover portion is too large compared to the thickness of the cover portion 27. Here, the thickness of the cover portion 27 before crimping may be the thickness of an exposed part of the cover portion 27, which is not inserted into the cover crimping portion 9.

p According to the third embodiment, the same effects as in the first embodiment can be obtained. In addition, with the protruded linear-portions 39, further enhanced water cut-off performance can be obtained. In addition, since the protruded linear-portions 39 are formed in the second step of crimping, the movement of the cover portion 27 is not inhibited.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

For example, although aluminum is used for the electrical wires in the working examples, it is not limited thereto and copper may be used for the electrical wires.

In addition, a plurality of the terminal-equipped electrical wires of the present invention may be bundled in use. In the present invention, such a structure of a plurality of the terminal-equipped electrical wires bundled together is called a wire harness structure.

DESCRIPTION OF NOTATIONS

1 . . . terminal
3 . . . terminal body
5 . . . crimping portion
7 . . . cover crimping portion
9 . . . conductor crimping portion
10 . . . terminal-equipped electrical wire
11 . . . sealed portion

15 . . . elastic contacting piece
17 . . . front-end portion
19 . . . rear-end portion
21 . . . joint portion
23 . . . covered conductive wire
25 . . . conductive wire
27 . . . cover portion
31*a*, 31*b*, 33*a*, 33*b*, 35*a*, 35*b* . . . mold
32 . . . small-diameter portion
34 . . . large-diameter portion
37 . . . protruding portion
39 . . . protruded linear-portion

What is claimed is:

1. A method for manufacturing a terminal-equipped electrical wire that includes a covered conductive wire connected with a terminal, the terminal including a crimping portion, which crimps the covered conductive wire, and a terminal body; and the crimping portion including a cover crimping portion, which crimps a cover portion of the covered conductive wire, and a conductor crimping portion, which crimps a conductive wire exposed from the cover portion and parts of the crimping portion other than a part into which the covered conductive wire is inserted are sealed, the method comprising:

inserting the covered conductive wire into the crimping portion;

a first step of crimping including crimping the conductor crimping portion and the conductive wire as well as temporarily crimping the cover crimping portion and the cover portion; and a second step of crimping, following the first step of crimping, including crimping the cover crimping portion and the cover portion, wherein a compression rate (A1/A0) at the cover portion in the first step of crimping is 85% or more and less than 100%, and A0 is a cross-sectional area of the cover portion before crimping and A1 is an inner cross-sectional area of the cover crimping portion after the first step of crimping.

2. The method for manufacturing the terminal-equipped electrical wire according to claim 1, wherein:

the second step of crimping includes forming a protruded linear-portion that protrudes toward an inner surface of the cover crimping portion and is continuous in a circumferential direction.

3. The method for manufacturing the terminal-equipped electrical wire according to claim 2, wherein:

two or more rows of the protruded linear-portion are formed.

4. The method for manufacturing the terminal-equipped electrical wire according to claim 1, wherein:

the first step of crimping includes the step of temporarily crimping the cover portion by the cover crimping portion followed by the step of crimping the conductive wire by the conductor crimping portion.

* * * * *